US011279106B2

(12) United States Patent
Linnestad

(10) Patent No.: US 11,279,106 B2
(45) Date of Patent: Mar. 22, 2022

(54) ROLLER MOUNTING ARRANGEMENTS

(71) Applicant: Elopak AS, Spikkestad (NO)

(72) Inventor: Even Linnestad, Spikkestad (NO)

(73) Assignee: Elopak AS, Spikkestad (NO)

( * ) Notice: Subject to any disclaimer, the term of this patent is extended or adjusted under 35 U.S.C. 154(b) by 92 days.

(21) Appl. No.: 16/491,581

(22) PCT Filed: Mar. 7, 2018

(86) PCT No.: PCT/EP2018/055520
§ 371 (c)(1),
(2) Date: Sep. 6, 2019

(87) PCT Pub. No.: WO2018/162511
PCT Pub. Date: Sep. 13, 2018

(65) Prior Publication Data

US 2021/0129476 A1 May 6, 2021

(30) Foreign Application Priority Data

Mar. 7, 2017 (GB) ..... 1703644

(51) Int. Cl.

| | |
|---|---|
| ***B31B 50/00*** | (2017.01) |
| ***B31B 50/14*** | (2017.01) |
| ***B31B 50/16*** | (2017.01) |
| ***B31B 50/25*** | (2017.01) |

(52) U.S. Cl.
CPC ..... *B31B 50/006* (2017.08); *B31B 50/146* (2017.08); *B31B 50/16* (2017.08); *B31B 50/256* (2017.08)

(58) Field of Classification Search
CPC ..... B31B 50/006; B31B 50/16; B31B 50/146; B31B 50/256; G03G 15/2092
See application file for complete search history.

(56) References Cited

U.S. PATENT DOCUMENTS

| | | | | | |
|---|---|---|---|---|---|
| 3,846,151 | A | * | 11/1974 | Roteman | G03G 15/2092 427/194 |
| 3,874,894 | A | * | 4/1975 | Pedersen | G03G 15/2092 430/124.23 |
| 3,990,391 | A | * | 11/1976 | Singh | G03G 15/2092 399/339 |
| 4,145,965 | A | * | 3/1979 | Kikuchi | G03G 15/2092 100/158 R |
| 4,188,109 | A | * | 2/1980 | Idenawa | G03G 15/2092 219/216 |
| 4,356,764 | A | * | 11/1982 | Haugen | G03G 15/2092 100/157 |

(Continued)

FOREIGN PATENT DOCUMENTS

| | | |
|---|---|---|
| EP | 0611187 | 2/1994 |
| EP | 1028056 | 8/2000 |

*Primary Examiner* — Thomas M Wittenschlaeger
(74) *Attorney, Agent, or Firm* — Christian D. Abel

(57) ABSTRACT

The invention relates to an apparatus comprising a pair of rollers (2) with a nip and having respective axes thereof in a common plane therebetween, first and second roller mounting arrangements (8) at respective opposite ends of said pair (2), said arrangements having a hinging system (26, 30) at one side of said common plane and whereby one of the pair of rollers (2) can be turned relative to the other. The invention also relates to an associated method.

7 Claims, 4 Drawing Sheets

(56) References Cited

U.S. PATENT DOCUMENTS

| | | | | | |
|---|---|---|---|---|---|
| 4,357,094 | A | * | 11/1982 | Zepko | G03G 15/2092 15/256.51 |
| 4,426,411 | A | * | 1/1984 | Sasaki | G03G 15/2092 205/222 |
| 4,732,082 | A | * | 3/1988 | Ireton | B21D 17/04 101/23 |
| 4,991,420 | A | * | 2/1991 | Frischknecht | B21B 31/30 72/244 |
| 5,140,378 | A | * | 8/1992 | Ibuchi | G03B 27/32 100/168 |
| RE34,503 | E | * | 1/1994 | Sakakibara | G03B 27/32 355/27 |
| 5,301,583 | A | | 4/1994 | Kakko-Chiloff | |
| 5,875,671 | A | * | 3/1999 | Hauck | B21B 31/04 72/237 |
| 6,209,377 | B1 | * | 4/2001 | Shore | B21B 13/02 72/237 |
| 9,156,071 | B2 | * | 10/2015 | Hackfort | B21B 37/62 |
| 2008/0006632 | A1 | | 3/2008 | Collard | |
| 2016/0000899 | A1 | | 1/2016 | Mex | |

* cited by examiner

ROLLER MOUNTING ARRANGEMENTS

This invention relates to a roller mounting arrangement.

It is known in converting plants in which a web of material is converted into blanks or reels to pass the web through a nip between a pair of cutting and/or creasing rollers, known as tool cylinders, either to produce blanks cut from the web and maybe formed with creases for subsequent folding and/or with cuts and/or with holes, or to form in the web such creases, and/or cuts and/or holes. In the latter instance, the web may be split longitudinally and wound to form reels. The web may be of packaging material, for example liquid packaging material in the form of a laminate comprising, progressing inwardly of a carton of the material, e.g. a moisture barrier layer (e.g. low density polyethylene—LDPE)/a substrate (e.g. paperboard)/a tie layer/an oxygen barrier layer (e.g. aluminium foil, or ethylene vinyl alcohol—EVOH)/a tie layer/a moister barrier layer (e.g. LDPE).

It is known for the pair of tool cylinders to be mounted at each end in a pair of bearing blocks. In each pair there are upper and lower blocks formed with respective circular through bores for receiving bearings carrying shafts of the cylinders. Each block has rectilinear, horizontal, parallel bottom and top faces and, immediately below the top face, an upper pair of horizontally projecting ears and, immediately above the bottom face, a lower pair of horizontally projecting ears. The ears have bolts passed through vertical bores therethrough and screwed into the lower block to fix the upper block to the lower block.

Each cylinder includes, at each of its ends, an annular radial bearer, so that there is formed between the bearers of each cylinder an annular recess in which can be mounted arcuate cutting and/or creasing plates. The load upon each pair of contacting bearers largely determines the cutting and/or creasing depths of the plates, which affects the quality of the blanks or reels produced.

In some known mounting arrangements for such cylinders, the bearer load is preset, for example by heavy-duty springs. It can be adjustable hydraulically or pneumatically.

According to one aspect of the present invention, there is provided apparatus comprising a pair of rollers with a nip and having respective axes thereof in a common plane therebetween, first and second roller mounting arrangements at respective opposite ends of said pair, said arrangements having a hinging system at one side of said common plane and whereby one of the pair of rollers can be turned relative to the other.

It is advantageous for the apparatus to include a restraining system at the opposite side of the common plane from the hinging system for restraining turning of the one of the pair of rollers away from the other about the hinging system.

Preferably, the restraining system comprises resilient means.

Each roller mounting arrangement may comprise first and second bearing blocks extending substantially perpendicularly to the common plane and formed with respective bores extending in the common plane for receiving respective roller bearings, the blocks of each roller mounting arrangement having a hinge device therebetween at one side of the common plane and constituting a portion of the hinging system. Each hinge device may include an ear of the first block and fixedly attached to the second block.

The restraining system may comprise, in each roller mounting arrangement and at the opposite side of the common plane, a restraining connection between the two blocks and restraining against turning of the blocks away from each other about the hinge device. Each restraining connection may comprise a resilient device urging the two blocks to turn towards each other about the hinge device.

If the apparatus is to be used for cutting and/or creasing and/or holing of a web, particularly a web of packaging material, around at least one of the rollers there can be a plate having cutting and/or creasing and/or holing devices for the web material passing through the nip.

According to another aspect of the present invention, there is provided a roller mounting arrangement comprising a bearing block extending generally in a first plane and formed with a bore having its axis substantially perpendicular to said plane for receiving a roller bearing, said block having, substantially perpendicular to said plane and extending parallelly to said axis, a substantially planar face for applying face-to-face to a substantially planar face of a second bearing block and having at one end of its planar face, a hinge part whereby it may turn towards and away from said second bearing block.

The hinge part preferably comprises an ear inwardly of the plane of the planar face of its block and flexibly connected to the remainder of its block. At the opposite end of the planar face and inwardly of the plane of that planar face there may be a second ear which is thicker than the other ear. At the second ear, there may be a restraining device serving to deter swinging of its block away from the other block.

According to a further aspect of the present invention, there is provided a roller mounting arrangement, comprising first and second bearing blocks extending generally in a first plane and formed with respective bores extending parallelly to each other and substantially perpendicularly to said plane for receiving respective roller bearings, the blocks having a hinge device therebetween at one side of the common plane of the axes of said bores.

According to a yet further aspect of the present invention, there is provided a method of treating a web, comprising passing the web through a nip between first and second rollers having respective axes in a common plane, while cutting and/or creasing and/or holing devices on at least one of said rollers cut and/or crease and/or hole said web and while enabling the first roller to turn in space relative to the second roller about an axis to one side of said common plane.

The method may include, at the opposite side of the common plane, restraining the first roller from relatively turning about the axis away from the second roller.

The restraining may comprise resiliently urging the first roller relatively towards the second roller about the axis.

The web may be of packaging material.

Owing to the invention, it is possible to make a simple and robust connection between the bearings of the upper and lower tool cylinders, without the bearer loads and hence cutting and/or creasing depth being strongly influenced by thermal expansion or other dimensional variations of the bearing blocks or the tool cylinders. Moreover, the use of an external surrounding frame can be avoided. Furthermore, connection to an external source of hydraulic or air pressure is not necessary, although this may be used if feasible.

In a preferred embodiment, two bearing blocks are bolted together vertically. One ear of one bearing block is made fairly thin in order to provide flexibility allowing the centre distance of the two bearing blocks to move "freely" within a moderate range sufficiently large to account for relevant dimensional changes caused by thermal expansion or other variations. The relatively thin mounting ear works as a hinge with high stiffness in the horizontal plane (because of the bolting thereof to the other block) and low stiffness in the vertical plane (contributing slightly to the bearer pre-load).

On the opposite side of the bearing blocks they are connected by a flexible spring arrangement providing a known clamping force which will ensure the pre-load on the bearers. The stiffness of this flexible spring arrangement is low enough to provide an almost constant pre-load force on the bearers over the whole relevant range of temperature variations. The spring connection may also comprise a damper to take out vibration energy of the system.

According to a yet further aspect of the invention, there is provided an apparatus comprising:

- a first cylinder or roller mounting arrangement rotatably supporting a first cutting and/or creasing and/or holing roller; and
- a second cylinder or roller mounting arrangement rotatably supporting a second cutting and/or creasing and/or holing roller, the rotational axes of the first and second cutting and/or creasing and/or holing rollers being parallel and forming a nip for cutting and/or creasing and/or holing a blank or a web of a packaging material, e.g. a liquid packaging material comprising a laminate of layers, wherein the first cylinder or roller mounting arrangement is pivotally mounted to the second cylinder or roller mounting arrangement about a pivot axis which is parallel to the rotational axes of the first and second cutting and/or creasing and/or holing rollers, and wherein a pre-load system is arranged to bias the first cylinder or roller mounting arrangement towards the second cylinder or roller mounting arrangement in a pivoting movement about the pivot axis.

The arrangement allows the pre-load system to keep the first and second cutting and/or creasing and/or holing rollers at a desired mutual distance when temperature variations cause thermal expansion and retraction of members in the apparatus.

The pivot axis and the pre-load system may advantageously be positioned on different sides of a plane defined by the rotational axes of the first and second cutting and/or creasing and/or holing rollers.

In order that the invention may be clearly and completely disclosed, reference will now be made, by way of example, to the accompanying drawings, wherein.

Figure 1:
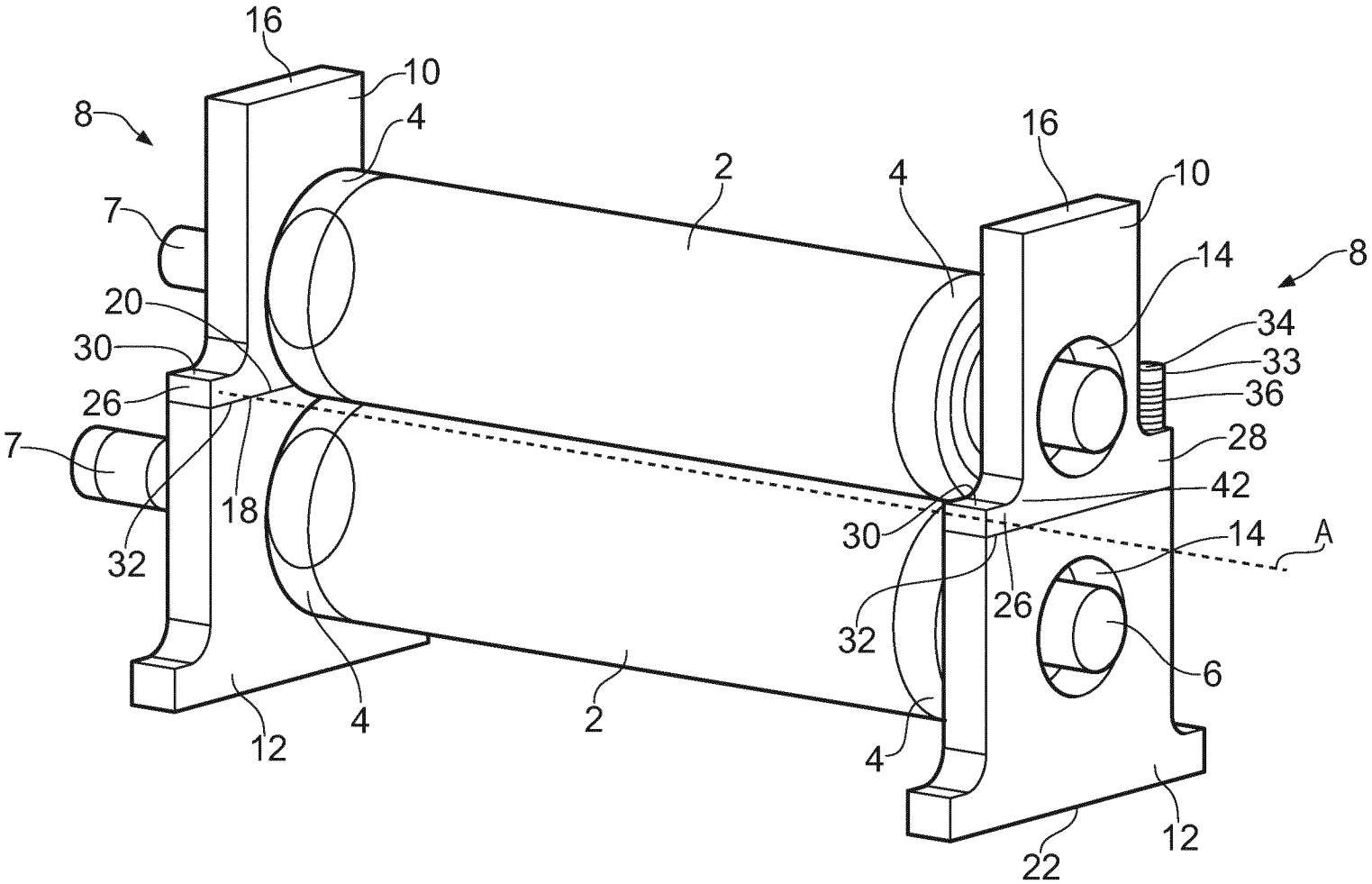
FIG. 1 shows a diagrammatic perspective view of a pair of cutting and/or creasing and/or hole-making tool cylinders, with their two cylinder mounting arrangements, for a converting plant.

Referring to FIG. 1 of the drawings, there are shown the pair of steel rollers, i.e. tool cylinders, 2 with annular bearers 4 integral therewith and end shafts 6 and 7 also integral therewith. The lower of the end shafts 7 is a drive shaft. At each end of the pair of tool cylinders 2 is a cylinder mounting arrangement 8 comprising upper and lower bearing blocks 10 and 12 which generally extend in a common vertical plane. Through the blocks 10 and 12 at each end and with axes parallel to each other and perpendicular to that vertical plane are respective bores 14 housing the bearings (not shown) carrying the end shafts 6. Each upper block 10 has an upper, horizontal, rectangular, planar face 16 and a lower, rectangular, horizontal, substantially planar face 18. Each lower face 18 is arranged face-to-face with an upper, horizontal, rectangular, substantially planar, upper face 20 of the block 12 therebelow. The lower face 22 of the block 12 is rectangular, planar and horizontal for resting upon a floor or a foundation. The upper block 10 has, immediately above the plane of the surface 18, two ears 26 and 28, of which the ear 26 is thinner in the vertical direction than is the ear 28. By means of a sturdy bolt 30, possibly with the interposition of a shim 32, the ear 26 is bolted to the lower block 12. At each end of the pair of cylinders 2 and by means of a bolt 34 and a nut 33 thereon a spring 36 is urged downwards against the thicker ear 28 of the upper block 10, so that that ear is pressed downwards to pre-load the bearers 4 against each other. The bolt 34 extends vertically significantly into the block 12 and terminates at its upper end at the nut 33. The thinner ear 26 and the remainder of the block 10 are flexibly interconnected, so that the remainder of the block 10 is thus able to hinge very slightly about its thinner ear 26 to allow the bearer preload provided by the spring 36 to remain substantially constant in spite of thermal expansion.

Consequently, ears 26 of blocks 10 are fixedly attached to blocks 12 by virtue of bolts 30 while ears 28 are allowed to move vertically vis-à-vis blocks 12 by virtue of the bolt 34, nut 33 and spring 36 arrangement, thus giving the upper cylinder or roller mounting arrangement (which carries the upper tool cylinder) the freedom to pivot in relation to the lower cylinder or roller mounting arrangement (which carries the lower tool cylinder) about a pivot axis A created due to elasticity in region 42 of ears 26 connecting each ear 26 to the rest of the block 10 (see also FIG. 2), said region 42 thus forming a flexible interconnection connecting ear 26 to the rest of the block 10.

In other words, ears 26 and bolts 30 form a hinging system of the apparatus allowing the upper cylinder or roller mounting arrangement to pivot vis-à-vis the lower cylinder or roller mounting arrangement about the pivot axis A.

Consequently, the rotational axes of the tool cylinders 2 are parallel and the bearers 4 form a nip for cutting and/or creasing and/or holing a blank or a web of a packaging material, e.g. a liquid packaging material comprising a laminate of layers, wherein the cylinder or roller mounting arrangement of the upper tool cylinder is pivotally mounted to the cylinder or roller mounting arrangement of the lower tool cylinder about a pivot axis A which is parallel to the rotational axes of the tool cylinders. The bolt 34, nut 33 and spring 36 arrangement at each ear 28 form a pre-load system that will bias the roller mounting arrangement of the upper tool cylinder towards the roller mounting arrangement of the lower tool cylinder in a pivoting or flexing movement about the pivot axis, but will allow ears 28 to move towards or away from blocks 12 to accommodate for thermal expansion and retraction of members in the apparatus.

This will allow the pre-load system to keep the tool cylinders 2 at a desired mutual distance independent of temperature variations.

Figure 2:
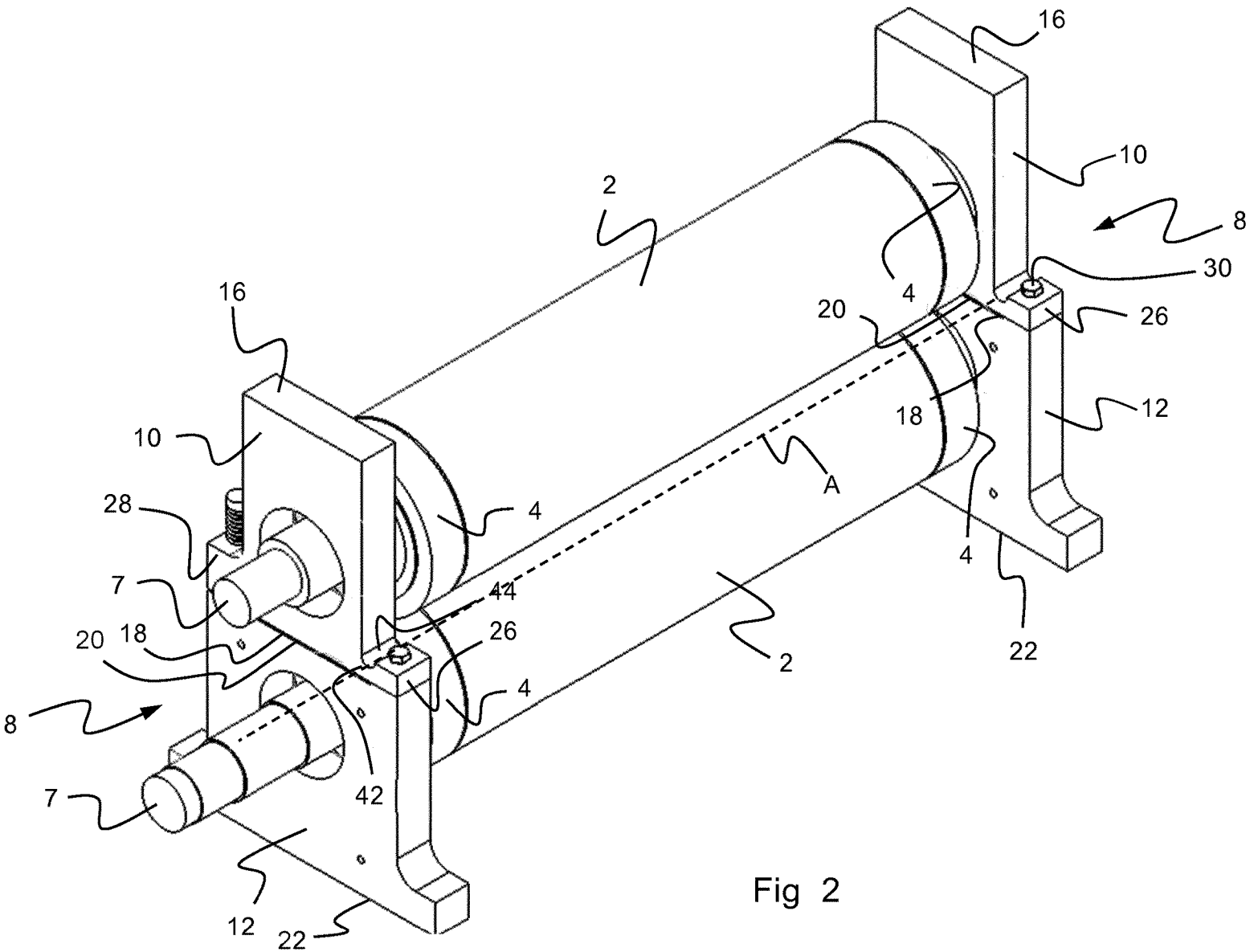
FIG. 2 shows a diagrammatic perspective view of a second embodiment of a pair of cutting and/or creasing and/or hole-making tool cylinders, with their two cylinder mounting arrangements, for a converting plant
Figure 3:
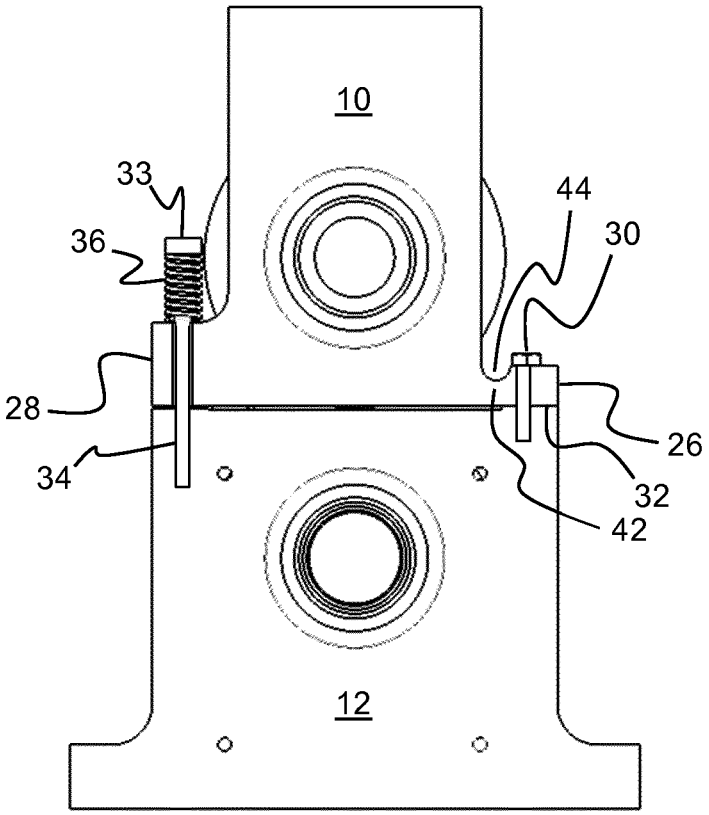
FIG. 3 shows the apparatus of FIG. 2 in a first side view.
Figure 4:
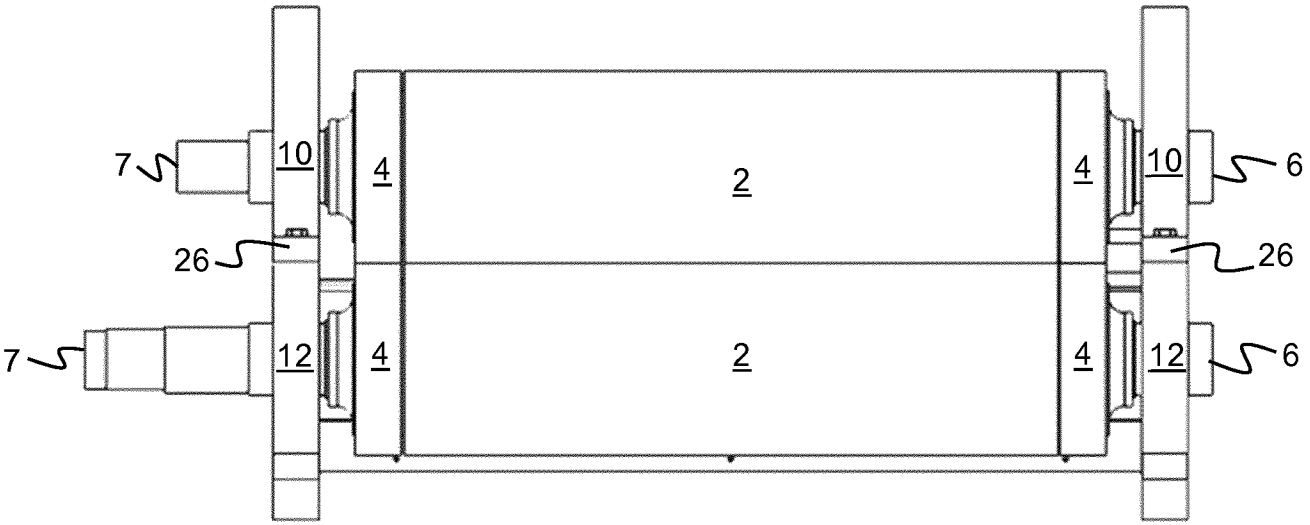
FIG. 4 shows the apparatus of FIG. 2 in a second side view.

Referring now to FIGS. 2-4 of the drawings, it is shown an apparatus which is essentially identical to the apparatus shown in FIG. 1, the only difference being that the flexible interconnection 42 connecting each ear 26 to the rest of the block 10 comprises a recess 44 giving the interconnection 42 a vertical height which is less than the vertical height of the outer end of ear 26, thus rendering the flexible interconnection 42 more elastic than the corresponding interconnection in FIG. 1.

The invention claimed is:

1. Apparatus comprising a pair of rollers with a nip and having respective axes thereof in a common plane therebetween, first and second roller mounting arrangements at respective opposite ends of said pair, said arrangements having a hinging system at a first side of said common plane and whereby one of the pair of rollers can be turned relative to the other, wherein each roller mounting arrangement, comprises first and second bearing blocks extending substantially perpendicularly to said common plane and formed with respective bores extending in said common plane for receiving respective roller bearings, the blocks of each roller mounting arrangement having a hinge device therebetween at the first side of said common plane and constituting a portion of said hinging system, wherein each hinge device includes an ear of the first block and fixedly attached to a planar face of the second block, the apparatus further comprising, in each roller mounting arrangement and at a second side of said common plane being opposite said first side, a restraining connection between the two blocks and restraining against turning of the blocks away from each other about said hinge device, wherein said restraining connection comprises a resilient device urging the two blocks to turn towards each other about said hinge device, and wherein a pivot axis is created due to elasticity in a region of said ear of each hinging device forming a flexible interconnection connecting the ear to the rest of the block.

2. Apparatus according to claim 1, further comprising, around at least one of the rollers, a plate having cutting and/or creasing and/or holing devices for web material passing through said nip.

3. A method of treating a web using the apparatus according to claim 1, the method comprising passing the web through said nip between said first and second rollers having respective axes in said common plane, while cutting and/or creasing and/or holing devices on at least one of said rollers cut and/or crease and/or hole said web and while enabling the first roller to turn in space relative to the second roller about an axis to said first side of said common plane.

4. A method according to claim 3 and, at said second side of said common plane, restraining said first roller from relatively turning about said axis away from said second roller.

5. A method according to claim 3, wherein said restraining comprises resiliently urging said first roller relatively towards said second roller about said axis.

6. A method according to any one of claims 3 to 5, wherein said web is of packaging material.

7. A roller mounting arrangement comprising a first bearing block extending generally in a first plane and formed with a bore having its axis substantially perpendicular to said plane for receiving a roller bearing, said first bearing block having, substantially perpendicular to said plane and extending parallelly to said axis, a substantially planar face for applying face-to-face to a substantially planar face of a second bearing block and having at a first end of its planar face, a hinge part whereby it may turn towards and away from said second bearing block, wherein said hinge part comprises a first ear above the plane of the planar face of the first bearing block and flexibly connected to a remainder of the first bearing block, the roller mounting arrangement further comprising, at a second end of said planar face opposite the first end of said planar face and above the plane of said planar face of the first bearing block a second ear which is thicker than the first ear, the roller mounting arrangement further comprising, at said second ear, a restraining device serving to deter swinging of the first bearing block away from said second bearing block, wherein a pivot axis is created due to elasticity in a region of said first ear forming a flexible interconnection connecting the first ear to the rest of the block.

* * * * *